US009487037B2

(12) United States Patent
Shiode et al.

(10) Patent No.: US 9,487,037 B2
(45) Date of Patent: Nov. 8, 2016

(54) PRINTING APPARATUS

(71) Applicant: SEIKO EPSON CORPORATION, Tokyo (JP)

(72) Inventors: Takeshi Shiode, Matsumoto (JP); Akio Yamazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/665,628

(22) Filed: Mar. 23, 2015

(65) Prior Publication Data

US 2015/0266321 A1 Sep. 24, 2015

(30) Foreign Application Priority Data

Mar. 24, 2014 (JP) ..... 2014-060870

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 13/00*** | (2006.01) |
| ***B41J 11/00*** | (2006.01) |
| ***B41J 11/42*** | (2006.01) |

(52) U.S. Cl.

CPC ..... *B41J 13/0009* (2013.01); *B41J 11/0095* (2013.01); *B41J 11/42* (2013.01)

(58) Field of Classification Search

CPC .... B41J 29/393; B41J 29/38; B41J 11/0095; B41J 11/42; B41J 11/007; B41J 13/0027; B41J 11/46; B41J 13/0009

USPC ..... 347/14, 16, 19, 104

See application file for complete search history.

(56) References Cited

U.S. PATENT DOCUMENTS

| | | | | |
|---|---|---|---|---|
| 6,805,425 | B2 | 10/2004 | Hayashi et al. | |
| 2003/0156150 | A1* | 8/2003 | Hayashi | B65H 7/14 347/19 |
| 2009/0102874 | A1* | 4/2009 | Ito | B41J 29/38 347/9 |
| 2013/0216291 | A1* | 8/2013 | Fukusaka | B41J 13/0009 400/583 |

FOREIGN PATENT DOCUMENTS

| | | |
|---|---|---|
| JP | 2003-267591 | 9/2003 |
| JP | 2003/267591 | 9/2003 |

OTHER PUBLICATIONS

European Search Report Application No. 15160486.5 dated Aug. 17, 2015.

* cited by examiner

*Primary Examiner* — Jannelle M Lebron
(74) *Attorney, Agent, or Firm* — Workman Nydegger

(57) ABSTRACT

A printing apparatus includes: a transport unit that has a transport roller which transports a medium; a detection unit that has an image acquiring section which acquires an image of the medium and that detects a transport amount of the medium based on the image acquired by the image acquiring section; and a control unit that controls the transport unit based on a detection amount which is the transport amount detected by the detection unit. The control unit calculates a correction amount with which the transport amount of the medium is corrected, based on the detection amount. When the detection amount is an abnormal value, the transport unit is controlled based on the correction amount obtained before the detection amount becomes the abnormal value.

7 Claims, 5 Drawing Sheets

TEMPLATE DETERMINATION

TEMPLATE MATCHING

PRINTING APPARATUS

BACKGROUND

1. Technical Field

The present invention relates to a printing apparatus.

2. Related Art

A printing apparatus in the related art includes a transport unit that transports a medium such as a sheet and a printing unit that has a print head which performs printing on the medium transported by the transport unit. The transport unit has a transport roller which transports the medium, a feed motor that rotates the transport roller, and a detection unit which detects a transport amount of the medium.

When the medium is transported by the transport roller, slippage occurs between the medium and the transport roller in some cases. In a case where such slippage occurs, the transport amount of the medium with respect to a rotation amount of the transport roller varies from a transport amount of the medium with respect to a rotation amount of the transport roller which is obtained when there is no slippage between the medium and the transport roller. In order to stop the variation, the printing apparatus in the related art controls the transport amount of the medium by a feedback control which causes a detection amount which is the transport amount of the medium which is detected by the detection unit to be approximate to a theoretical transport amount which is a transport amount on design in a case where the medium is transported by one pulse drive of the feed motor.

In a case where the detection unit outputs a detection amount which is significantly different from an actual transport amount, that is, a case where the detection unit detects an abnormal value as the detection amount, the printing apparatus in the related art controls the transport amount of the medium based on the abnormal value, and thus, transport of the medium is performed inaccurately.

In regards to such a problem, JP-A-2003-267591 discloses a printing apparatus (image forming apparatus) that sets a normal range in advance with a theoretical transport amount as a reference and controls a transport amount of a medium based on a predetermined specified transport amount instead of a detection amount when the detection amount is not within the normal range, that is, the detection amount is an abnormal value. Accordingly, since the abnormal value is not used as a value used to control the transport amount of the medium, inaccurate transport of the medium is prevented. The specified transport amount is a preset fixed value.

Incidentally, it is technologically difficult to manufacture a perfectly-circular circumferential shape of the transport roller which is a cross-sectional shape orthogonal to an axial direction thereof. Therefore, the rotation amount of the transport roller by one pulse drive of the feed motor varies depending on a rotation position of the transport roller in some cases. Thus, the transport amount of the medium through the rotation of the transport roller by the one pulse drive of the feed motor varies depending on a rotation position of the transport roller in some cases. In addition, a slippage amount between the medium and the transport roller varies depending on the types of media (types of sheets) in some cases.

In the printing apparatus in the related art, the specified transport amount is a fixed value and a slippage amount between the medium and the transport roller, the variation of the slippage amount depending on the types of media (types of sheets), or the variation of the transport amount depending on the circumferential shape of the transport roller is not reflected in the specified transport amount. Therefore, there is a concern that inaccurate transport of the medium is performed even by controlling the transport amount of the medium based on the specified transport amount, and thus, there is still room for improvement.

SUMMARY

An advantage of some aspects of the invention is to provide a printing apparatus which is able to prevent inaccurate transport of a medium.

Hereinafter, means of the invention and operation effects thereof will be described.

According to an aspect of the invention, there is provided a printing apparatus including: a transport unit that has a transport roller which transports a medium; a detection unit that has an image acquiring section which acquires an image of the medium and that detects a transport amount of the medium based on the image acquired by the image acquiring section; and a control unit that controls the transport unit based on a detection amount which is the transport amount detected by the detection unit. When the detection amount is a normal value, the control unit calculates a correction amount with which the transport amount of the medium is corrected, based on the detection amount and an instruction amount which is an instructed value by which the medium is transported, and controls the transport unit based on a target transport amount which is a target value of transport of the medium and includes the correction amount. When the detection amount is an abnormal value, the control unit calculates an alternative correction amount based on the correction amount obtained before the detection amount becomes the abnormal value and controls the transport unit based on the target transport amount that includes the alternative correction amount.

According to the configuration, since the correction amount of the transport amount of the medium is calculated based on the detection amount and the instruction amount so as to be reflected to the target transport amount, for example, a slippage amount between the medium and the transport roller, a variation of the slippage amount depending on the types of media, or a variation of the transport amount depending on the circumferential shape of the transport roller is reflected in the target transport amount. When the detection amount is an abnormal value, since the control unit calculates an alternative correction amount based on the correction amount obtained before the detection amount becomes the abnormal value, the target transport amount is a value including the correction amount of the previous transport process. Accordingly, the target transport amount is a value in which a slippage amount between the medium and the transport roller, a variation of the slippage amount depending on the types of media, or a variation of the transport amount depending on the circumferential shape of the transport roller is reflected. Thus, it is possible to prevent inaccurate transport of the medium.

In the printing apparatus, it is preferable that the control unit acquires unit instruction amounts which are transport instruction amounts per one transport process of the medium and unit detection amounts which are the detection amounts per one transport process of the medium, and stores the accumulated detection amount which is obtained by accumulating a plurality of the unit detection amounts and calculates a correction amount for each of the unit instruction amounts based on the accumulated detection amount. In addition, it is preferable that, when the detection amount is an abnormal value, the control unit replaces the unit detection amount that includes the abnormal value, of the accumulated detection amount, with the unit instruction amount corresponding to the unit detection amount, and calculates the alternative correction amount.

According to the configuration, since the alternative correction amount is calculated based on the accumulated detection amount, another unit detection amount which does not include the abnormal value of the accumulated detection amount includes an influence of the previous transport process even in a case where the unit detection amount including the abnormal value, of the accumulated detection amount, is replaced with the unit instruction amount. Therefore, since the correction amount (alternative correction amount) is calculated based on such accumulated detection amount and then, the target transport amount is calculated, the target transport amount becomes a value including the correction amount (alternative correction amount) of the previous transport process. Thus, it is possible to prevent inaccurate transport of the medium.

In the printing apparatus, it is preferable that the unit detection amounts of at least one rotation of the transport roller are accumulated in the accumulated detection amount.

According to the configuration, the accumulated transport amount of one rotation of the transport roller is calculated. Accordingly, when the target transport amount is calculated, it is possible to smooth the variation of the transport amount of the medium due to the circumferential shape of the transport roller.

In the printing apparatus, it is preferable that the accumulated detection amount is a transport amount which is obtained by accumulating N ($N \geq 2$ and N is an integer) unit detection amounts. In addition, it is preferable that, when the unit detection amount is newly added to the accumulated detection amount, the control unit removes, from the accumulated detection amount, the unit detection amount before the N-th unit detection amount from the most recent amount.

As the number of the accumulated unit detection amount becomes greater, the reflection of a slippage amount between the medium and the transport roller, a variation of the slippage amount depending on the types of media, or a variation of the transport amount depending on the circumferential shape of the transport roller becomes less in each of the unit detection amounts. When the accumulated detection amounts are calculated, the upper limit of the number of the unit detection amounts is provided and thereby, it is possible to calculate the target transport amount in a state in which the reflection of the slippage amount between the medium and the transport roller, the variation of the slippage amount depending on the types of media, or the variation of the transport amount depending on the circumferential shape of the transport roller remains in each of the unit detection amounts.

In the printing apparatus, it is preferable that the control unit acquires a unit instruction amount which is a transport instruction amount per one transport process of the medium. In addition, it is preferable that, when the detection amount is an abnormal value, the control unit adds the alternative correction amount to a unit instruction amount in the next transport process and calculates the target transport amount.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a printing apparatus is embodied in an ink jet-type printer will be described with reference to the drawings.

Figure 1:
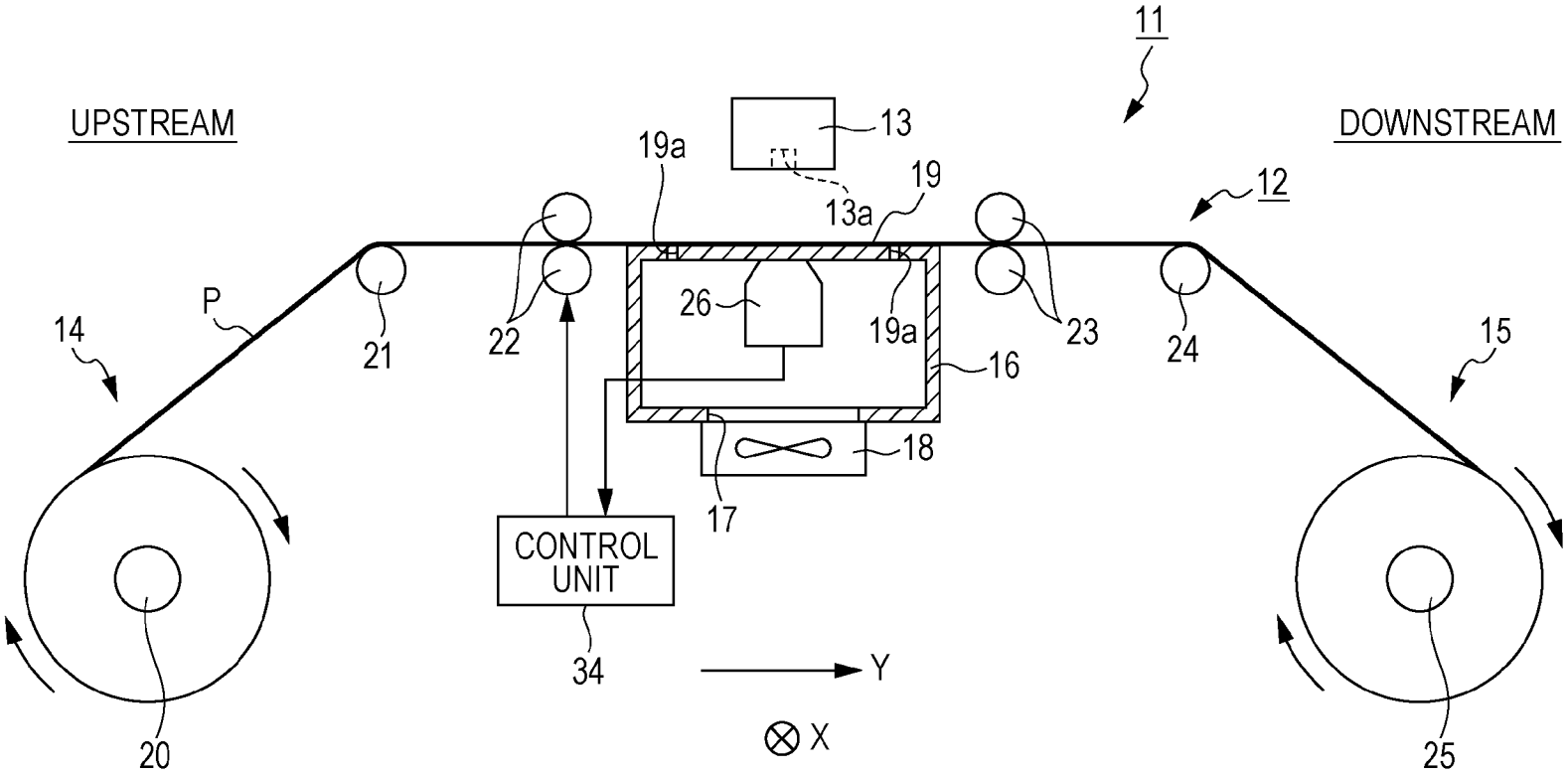
FIG. 1 is a view schematically illustrating a configuration of an ink jet-type printer of an embodiment.

As illustrated in FIG. 1, the ink jet-type printer (hereinafter, "printer 11") as an example of the printing apparatus includes a transport device 12 as an example of a transport unit that transports long sheet-shaped continuous paper P and a print head 13 that ejects ink (liquid) onto and performs printing on the continuous paper P which is transported by the transport device 12. The transport device 12 includes an unwinding unit 14 that unwinds the continuous paper P and a winding unit 15 that winds the continuous paper P which is unwound from the unwinding unit 14 and on which printing has been performed by the print head 13.

That is, in FIG. 1, the unwinding unit 14 is disposed at a left-side position which is the upstream side in a transport direction Y (in FIG. 1, right direction) in the continuous paper P and the winding unit 15 is disposed at a right-side position which is the downstream side. The print head 13 is disposed so as to face a transport path of the continuous paper P, between the unwinding unit 14 and the winding unit 15. A plurality of nozzles 13*a* which eject ink on the transported continuous paper P are formed on a surface of the print head 13 which faces the transport path of the continuous paper P.

In addition, a support member 16 that supports the continuous paper P is disposed at a position facing the print head 13 with the transport path of the continuous paper P interposed therebetween. The support member 16 has a bottomed quadrilateral box shape which has an opening 17 on the undersurface side opposite to the print head 13. A suction fan 18 that sucks in the inside of the support member 16 is provided on the undersurface of the support member 16 such that the suction fan 18 closes the opening 17. A level support surface 19 which supports the transported continuous paper P is configured of a surface of the support member 16 which faces the print head 13. A plurality of suction holes 19*a* are open on the support surface 19.

An unwinding shaft 20 extending in a width direction X (in FIG. 1, a direction orthogonal to the paper surface) of the continuous paper P orthogonal to the transport direction Y of the continuous paper P is provided in the unwinding unit 14 to be rotatably driven. On the unwinding shaft 20, the continuous paper P is supported to be integrally rotatable with the unwinding shaft 20 in a state in which the continuous paper P is wound in a roll shape in advance. The rotational drive of the unwinding shaft 20 causes the continuous paper P to be unwound toward the downstream side of the transport path from the unwinding shaft 20.

A first relay roller 21 which loops and guides the continuous paper P unwound from the unwinding shaft 20 to the print head 13 is rotatably disposed on the upper right side obliquely from the unwinding shaft 20. A feed roller pair 22 as an example of a transport roller which nips and guides the continuous paper P transported from the first relay roller 21 side, to the support surface 19 by being rotatably driven is disposed on the downstream side of the first relay roller 21 on the transport path of the continuous paper P.

A discharge roller pair 23 which nips the continuous paper P and guides a printed region of the continuous paper P to the downstream side of the transport path of the continuous paper P from the support surface 19 by being rotatably driven is disposed on the downstream side of the support surface 19 on the transport path of the continuous paper P. A second relay roller 24 which loops and guides the continuous paper P transported from the discharge roller pair 23 side to the winding unit 15 is rotatably disposed on the downstream side of the discharge roller pair 23 on the transport path of the continuous paper P. The winding unit 15 is positioned on the lower right side obliquely from the second relay roller 24.

A winding shaft 25 extending in the width direction X of the continuous paper P is provided in the winding unit 15 to be rotatably driven. The rotational drive of the winding shaft 25 causes the printed continuous paper P transported from the second relay roller 24 to be sequentially wound by the winding shaft 25.

Figure 2:
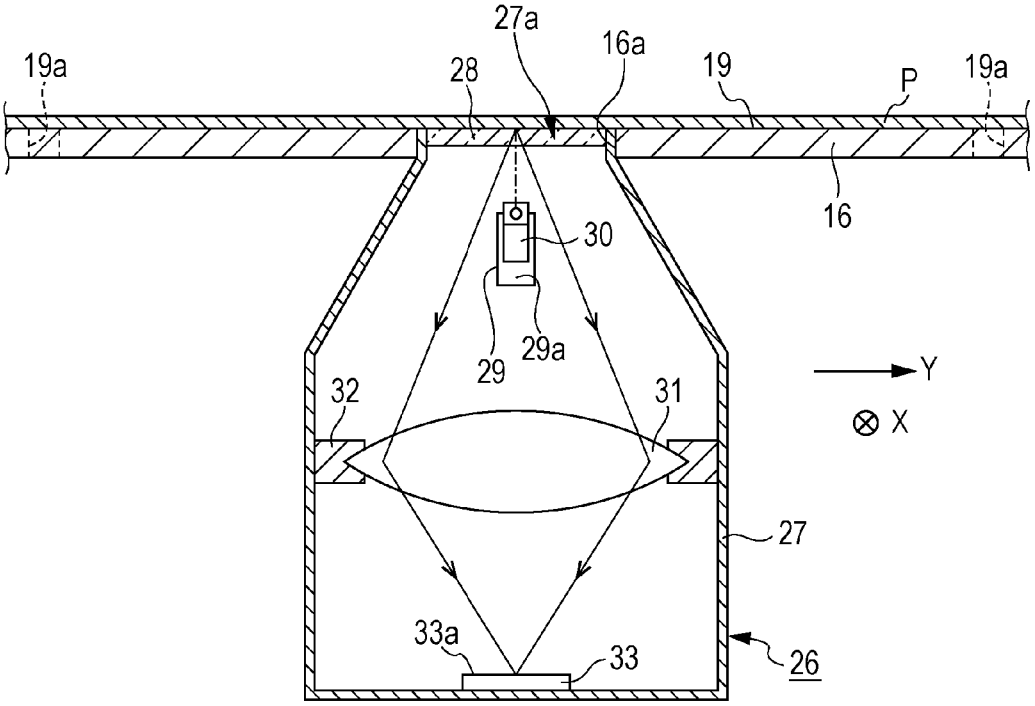
FIG. 2 is a schematic cross-sectional view of an imaging unit of the printer.

As illustrated in FIG. 2, a through-hole 16*a* which penetrates the support member 16 is formed at the center portion of the support surface 19. An imaging unit 26 which detects a transport amount of the continuous paper P in a non-contacting manner is fixed to the support member 16 in a state in which the upper end portion thereof is inserted into the through-hole 16*a*. In this case, the imaging unit 26 is disposed inside the support member 16. The imaging unit 26 has a control circuit (not illustrated) which controls the entire imaging unit 26.

The imaging unit 26 includes a case 27 which has a bottomed quadrilateral box shape. The upper section of the case 27 is tapered so as to have a narrower width when closer to the upper end. The case 27 is fixed to a fixed portion (not illustrated) in a state in which the upper end portion thereof is inserted into the through-hole 16*a* formed in the support member 16 from the interior side of the support member 16. In this case, the upper end of the case 27 becomes flush with the support surface 19 of the support member 16.

A rectangular opening on the upper end of the case 27 becomes a detection window 27*a* which is exposed to the support surface 19. A colorless and transparent light-transmissive glass 28 which transmits light is fitted to the detection window 27*a*.

In addition, a rectangular support plate 29 is provided on one side of the inner circumferential surface of the upper end portion of the case 27 in the width direction X of the continuous paper P. A light-irradiation unit 30 is attached on an attachment surface 29*a* of the support plate 29 which is a surface on the detection window 27*a* side.

In the present embodiment, the light-irradiation unit 30 is configured of a light-emitting diode (LED) and causes the continuous paper P transported on the support surface 19 to be irradiated with light through the light-transmissive glass 28 from the undersurface side (non-printing surface side) opposite to the printing surface. In this case, the light-irradiation unit 30 is disposed such that the undersurface (non-printing surface) of the continuous paper P is obliquely irradiated with light from the width direction X side.

A condenser 31 is provided at a position far away from the light-irradiation unit 30 with respect to the continuous paper P in the case 27, that is, a position on the lower side from the light-irradiation unit 30 in the case 27. The condenser 31 is held through a holding member 32 on the inner circumferential surface of the case 27 and condenses reflected light which is incident in the case 27 after light which is emitted from the light-irradiation unit 30, then, is transmitted through the light-transmissive glass 28, is reflected from the undersurface of the continuous paper P, and then, is again transmitted through the light-transmissive glass 28.

Further, an imaging element 33 which has an imaging surface 33*a* on which an image of the undersurface of the continuous paper P is formed by being condensed by the condenser 31 is provided at a position far away from the condenser 31 with respect to the continuous paper P in the case 27, that is, on the interior bottom surface of the case 27. The imaging element 33 is configured of, for example, a two-dimensional image sensor.

In addition, the condenser 31 is held at a height at which the image on the undersurface of the continuous paper P is formed on the imaging surface 33*a* of the imaging element 33 and on the inner circumferential surface of the case 27 through the holding member 32. In this case, the condenser 31 is disposed such that the optical axis thereof passes through the center of the detection window 27*a* and the center of the imaging surface 33*a*.

An image captured by the imaging unit 26 is output to a control unit 34 (refer to FIG. 1) which is configured to have a microcomputer, a memory, and the like. The control unit 34 calculates an actual transport amount (detection amount) of the continuous paper P based on the image of the imaging unit 26. The control unit 34 performs transport control which controls the transport of the continuous paper P based on a target transport amount and the actual transport amount.

Figure 3A:
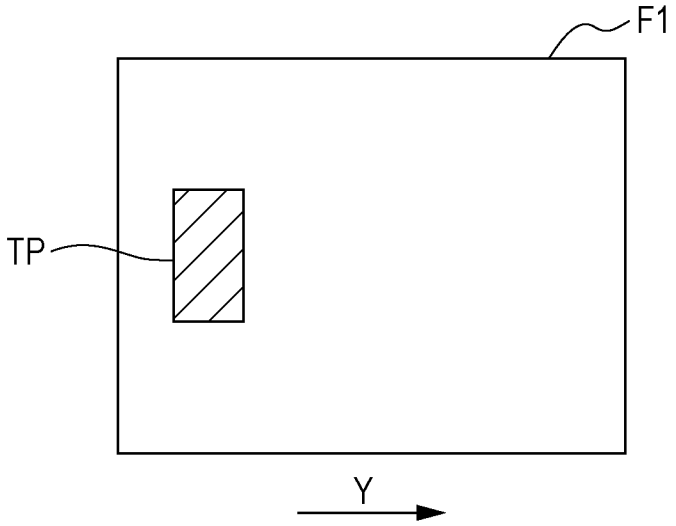
FIGS. 3A and 3B are views illustrating a template matching process.
Figure 3B:
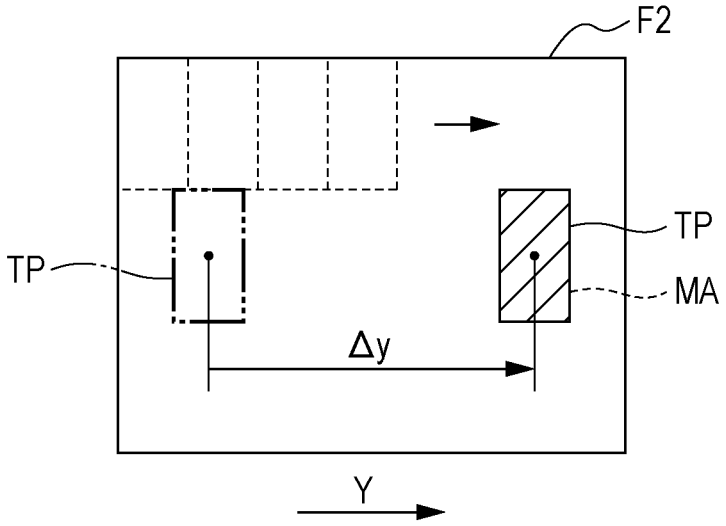

Next, detection of the transport amount of the continuous paper P by the control unit 34 will be described with reference to FIGS. 3A and 3B. FIGS. 3A and 3B illustrate two before-and-after images which are captured by the imaging unit 26 and compared them to each other in a time series. In images F1 and F2, textures of the rear surface of the continuous paper P are imaged. First, the control unit 34 designates, for example, a template TP having a rectangular area at a predetermined position (template designating position) on the upstream side on the image in the transport direction Y in M-th image F1 (here, M is a natural number) illustrated in FIG. 3A. The template designating position is designated at a position at which the rectangular area designated as the template TP on the image F1 is placed in the next image F2 after a predetermined time elapses. The texture of the template TP becomes a characteristic surface pattern which is not found at other positions on the rear surface of the continuous paper P (refer to FIG. 1).

Next, the control unit 34 moves the template TP designated over the previous M-th image onto the M+1-th image F2 illustrated in FIG. 3B and, at the same time, calculates similarity to rectangular areas illustrated in dotted lines (actually, a rectangular area for each pitch which is sufficiently smaller than in FIG. 3B) in order. Then, the control unit 34 performs a template matching process in which a position of a matching area MA having the maximum similarity is searched. As a result of the template matching process, when the matching area MA having the maximum similarity to the template TP as illustrated in FIG. 3B is found, the control unit 34 calculates a distance in the transport direction Y between the template designating position (for example, a central coordinate of the template TP) illustrated in by a two-dot chain line on the image F2 and a position of the matching area MA (for example, a central coordinate of the matching area MA). The calculated distance becomes a movement Δy per a predetermined time. The control unit 34 integrates the movements Δy during one transport process and thereby, calculates a unit detection amount which is a transport amount per one transport process. In a printing process of the printer 11, the one transport process represents a cycle of a transport process of the continuous paper P when printing is performed on the continuous paper P by repeating a plurality of cycles of printing on the continuous paper P by the print head 13 from the transport of the continuous paper P.

Next, detailed contents of the transport control which is performed by the control unit 34 are described with reference to FIG. 4. In the following description with reference to FIG. 4, configurational elements in printer 11 to which reference signs are attached indicate configurational elements of the printer 11 described in FIG. 1 and FIG. 2.

In Step S1, the control unit 34 acquires a unit instruction amounts which are transport instruction amounts of one transport process. The unit instruction amount is set based on print data stored in an information processing apparatus such as a personal computer connected to the printer 11 and is transmitted to the control unit 34. In addition, the unit instruction amounts become different values in transport processes in some cases. For example, the unit instruction amount in the transport process corresponding to an end portion of the continuous paper P at the time of printing start and the end portion thereof at the time of printing end is less than the unit instruction amount in the transport process corresponding to a section between the end portion of the continuous paper P at the time of printing start and the end portion thereof at the time of printing end. In addition, the unit instruction amount varies depending on a printing mode. Specifically, during a print mode of fast printing on the continuous paper P, the unit instruction amount increases and, during a print mode of printing on the continuous paper P with high image quality, the unit instruction amount decreases.

In Step S2, the control unit 34 transports the continuous paper P based on the unit instruction amount. In Step S3, the control unit 34 determines whether or not the printing ends. In a case where it is determined that printing ends (Step3: YES), the control unit 34 ends the transport control. On the other hand, in a case where it is determined that printing does not end (Step3: NO), the control unit 34 calculates the unit detection amount based on the image acquired by the imaging unit 26 in Step S4 and determines whether or not the detection error occurs in the imaging unit 26 in Step S5.

The detection error by the imaging unit 26 is determined as follows. That is, the control unit 34 multiplies the unit instruction amount by a coefficient k (for example, k=0.2) and then, a threshold value is calculated. Specifically, as the threshold value, the control unit 34 multiplies the unit instruction amount by (1+k) and thereby, calculates the upper limit threshold value and multiplies the unit instruction amount by (1−k) and thereby, calculates the lower limit threshold value. The control unit 34 determines whether or not the unit detection amount is in a range of greater than the lower limit threshold value and less than the upper limit threshold value. When the unit detection amount is within a range described above, the control unit 34 determines that the unit detection amount is a normal value, that is, that the imaging unit 26 does not produce a detection error and, when the unit detection amount is out of the range described above, determines that the unit detection amount is an abnormal value, that is, that the imaging unit 26 produces a detection error.

When the imaging unit 26 does not produces a detection error (Step S5: NO), the control unit 34 calculates a correction amount to be obtained at normal time in Step S6.

The calculation method of the correction amount to be obtained at normal time is described in detail.

In the process of transport operation of the continuous paper P, slippage occurs between the continuous paper P and the feed roller pair 22 in some cases. Therefore, the unit detection amount is different from the unit instruction amount due to the slippage in some cases.

In addition, in processing, it is difficult for each roller of the feed roller pair 22 to have a perfectly-circular circumferential shape which is a cross-sectional shape orthogonal to the axial direction thereof. Therefore, each roller of the feed roller pair 22 has an ellipsoidal circumferential shape in some cases. In such a case, one roller (hereinafter, "drive roller") of the feed roller pair 22 is caused to rotate and be driven by a feed motor (not illustrated) and the rotation amount (less than one rotation of the roller) of the drive roller per one step of the feed motor is different from a rotation angle of the drive roller. A transport instruction amount per one step of the feed motor is set on the premise that the drive roller has the perfectly-circular circumferential shape. Therefore, the instruction amount per one step of the feed motor is constant regardless of the rotation angle of the drive roller. Accordingly, the rotation amount of the drive roller per one step of the feed motor becomes different from the instruction amount per one step of the feed motor. Therefore, in some cases, the rotation amount of the drive roller per one step of the feed motor becomes significantly different from the instruction amount per one step of the feed motor due to the circumferential shape of the drive roller.

The control unit 34 sets the number of steps of the feed motor per one rotation of the drive roller of the feed roller pair 22 in advance. Accordingly, accumulated instruction amount which is the instruction amounts per one rotation of the drive roller is set. In addition, the control unit 34 accumulates the unit detection amounts during one rotation of the drive roller and thereby, calculates the unit detection amounts which are the detection amounts per one rotation of the drive roller. The control unit 34 calculates a correction amount with which the target transport amount is calculated in the next transport process based on the accumulated instruction amount and the accumulated detection amount. Therefore, the influence of the circumferential shape of the drive roller of the feed roller pair 22 is smoothened.

So as to transport the continuous paper P to an appropriate position with respect to the print head 13 in accordance with such variations of the transport amount, there is a need to transport the continuous paper P in reflection of the slippage amount between the continuous paper P and the drive roller of the feed roller pair 22 and the variation of the transport amount of the continuous paper P due to the circumferential shape of the drive roller.

The control unit 34 calculates the correction amount per the unit instruction amount based on the following equation (1).

$$C=(RV-CV)/CV\times NCV \quad (1)$$

Here, "C" represents a correction amount per unit instruction amount. "RV" represents an accumulated detection amount. "CV" represents an accumulated instruction amount. "NCV" represents a unit instruction amount in the next transport process.

In the above equation (1), the accumulated instruction amount is subtracted from the accumulated detection amount and thereby, a slippage amount per one rotation of the feed roller pair 22 is calculated. The obtained value is divided by the accumulated instruction amount and thereby, a slippage amount per a unit instruction amount is calculated. The next unit instruction amount is multiplied by the slippage per the unit instruction amount and thereby, a correction amount with which the actual transport amount by the feed roller pair 22 becomes equal to the next unit instruction amount.

Figure 5:
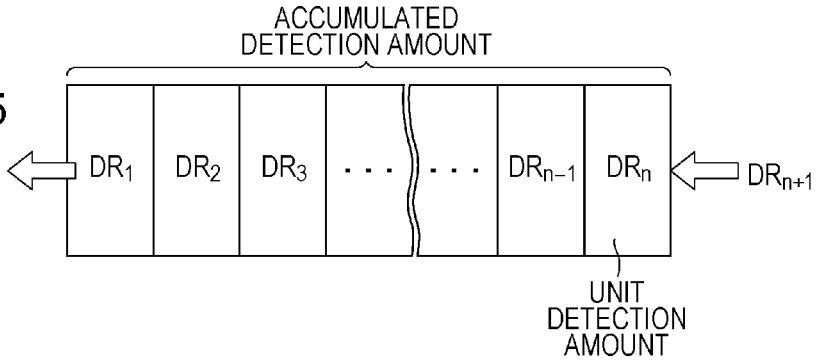
FIG. 5 is a diagram illustrating data addition of a unit detection amount to an accumulated detection amount.

In addition, since the unit instruction amount varies in the printing process in some cases, the control unit 34 calculates the accumulated instruction amount in each printing process. Therefore, the control unit 34 sequentially adds the actual transport amount to the accumulated detection amount and, at the same time, the oldest data is removed from data of the accumulated detection amount. To be more exact, as illustrated in FIG. 5, data of the accumulated detection amount is sequentially added and, at the same time, the oldest data is removed from the data of the accumulated detection amount. For example, in a case where the accumulated detection amount is calculated by accumulating N unit detection amounts, data $DR_{n+1}$ of the unit detection amount of the next transport process is added to the data of the accumulated detection amount and then, the latest data $DR_n$ moves to the next place and becomes data $DR_{n-1}$ in the data of the accumulated detection amount. Such data movement is performed in the entire data of the accumulated detection amount. Data $DR_2$ of the unit detection amount obtained before N−1 transport processes moves to the next place and becomes data $DR_1$ of the unit detection amount obtained before N transport processes. Accordingly, the oldest data $DR_1$ of the unit detection amount which is formerly present is removed. Accordingly, the control unit 34 updates the accumulated detection amount. Similarly, the control unit 34 updates the accumulated instruction amount.

Figure 4:
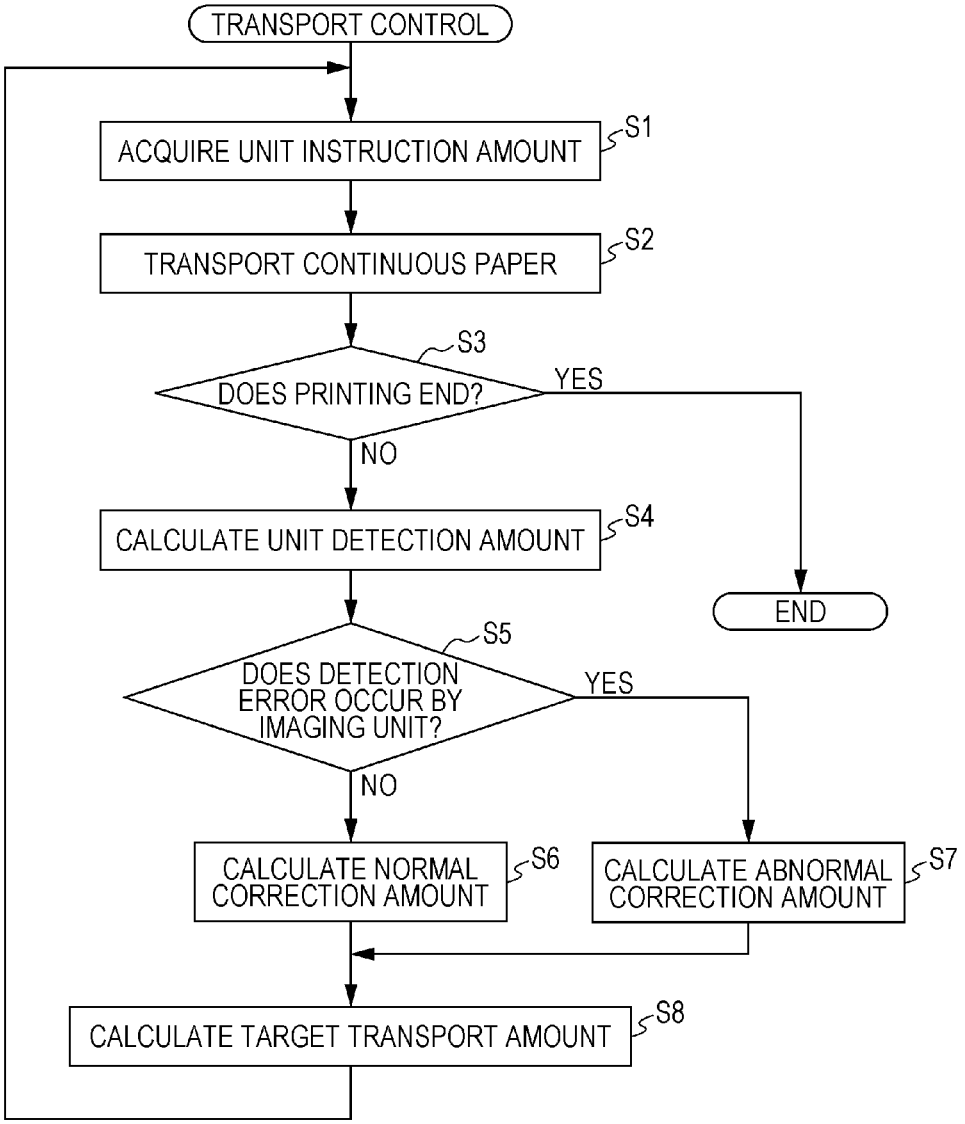
FIG. 4 is a flowchart illustrating a process procedure of transport control which is performed by the printer.

In addition, as illustrated in FIG. 4, when the imaging unit 26 produces a detection error in Step S5 (Step S5: YES), the control unit 34 calculates an alternative correction amount which is a correction amount obtained at an abnormal time in Step S7.

A calculation method of the alternative correction amount is described in detail.

The calculation method of the alternative correction amount is different from the calculation method of the correction amount obtained at a normal time in the following aspects.

Figure 6A:
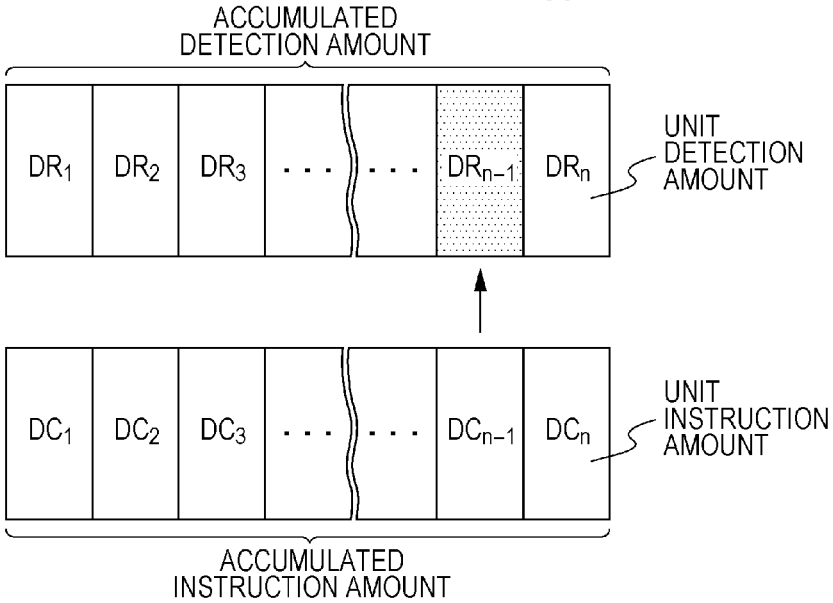
FIG. 6A is a diagram illustrating data replacement of the unit detection amount to and from the accumulated detection amount when the imaging unit issues a detection error in one unit detection amount and FIG. 6B is a diagram illustrating data replacement of the unit detection amount to and from the accumulated detection amount when the imaging unit issues a detection error in all of the unit detection amounts in the accumulated detection amount.

The control unit 34 changes the unit detection amount obtained when the imaging unit 26 produces a detection error to the unit instruction amount at that time. To be more exact, as illustrated in FIG. 6A, when data $DR_{n-1}$ of the unit detection amount marked by dots is determined as a detection error, the control unit 34 replaces the data $DR_{n-1}$ of the unit detection amount with data $DC_{n-1}$ of the unit instruction amount corresponding to the data. The control unit 34 calculates the correction amount per the unit instruction amount as the alternative correction amount based on the above equation (1).

Figure 6B:
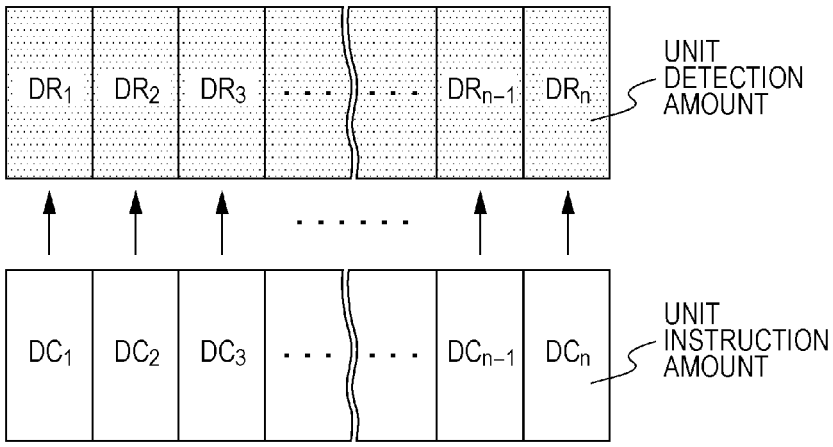

Incidentally, in a case where detection errors are continually produced due to a breakdown or the like of the imaging unit 26, the data of the unit detection amounts obtained when detection errors are produced is replaced with data of the unit instruction amounts corresponding to the data of the unit detection amount. In a case where detection errors are produced over one rotation of the feed roller pair 22, as illustrated in FIG. 6B, the entire data $DR_1$ to $DR_n$ of the unit detection amounts is replaced with data $DC_1$ to $DC_n$ of the unit instruction amounts corresponding to the data $DR_1$ to $DR_n$ of the unit detection amounts. In the above equation (1), since the value of RV-CV becomes "0", the alternative correction amount becomes "0".

After the control unit 34 calculates the correction amount (alternative correction amount), the control unit 34 calculates the target transport amount, in Step S8. To be more exact, the control unit 34 calculates the target transport amount based on the following equation (2). "GV" represents the target transport amount.

$$GV=RV/CV\times NCV+C \quad (2)$$

In the above equation (2), the accumulated detection amount is divided by the accumulated instruction amount and thereby, a degree of variation of the accumulated detection amount and the accumulated instruction amount is calculated. The unit instruction amount of the next transport process is multiplied to the variation degree, then, the correction amount is added, and thereby, a target transport amount is calculated, to which a variation amount of the accumulated detection amount and the accumulated instruction amount is added. In addition, in the above equation (2), in a case where detection errors are produced over one rotation of the feed roller pair 22, since the accumulated instruction amount is equal to the accumulated detection amount and the alternative correction amount becomes "0", the target transport amount becomes equal to the unit instruction amount of the next transport process. Therefore, during printing on the continuous paper P, in a case where detection errors are continually produced over one rotation of the feed roller pair 22, such a correction is not performed but the transport of the continuous paper P is performed based on the accumulated instruction amount.

As illustrated in FIG. 4, after calculating the target transport amount, the control unit 34 proceeds to Step S1 and acquires the unit instruction amount and transports the continuous paper P based on the target transport amount. Such transport path control is repeated until printing on the continuous paper P is finished.

Action of the printer 11 is described.

When the unit detection amount is an abnormal value and the accumulated detection amount including the unit detection amount is replaced with a pre-specified fixed value and then, the target transport amount is calculated, the slippage amount between the continuous paper P and the drive roller of the feed roller pair 22 or the variation amount of the accumulated detection amount with respect to the accumulated instruction amount due to the circumferential shape of the drive roller which is included in the accumulated detection amount is not reflected in the target transport amount. Therefore, an inaccurate transport of the continuous paper P is performed in some cases.

Alternatively, in the printer 11 of the present embodiment, when the unit detection amount is the abnormal value, the control unit 34 calculates an alternative correction amount in the transport control. In this case, although some unit detection amounts of the unit detection amounts are abnormal values, the other unit detection amounts of the unit detection amounts are normal values. Therefore, even when the unit detection amount which becomes the abnormal value is replaced with unit instruction amount corresponding to the unit detection amount, influence of the previous transport process remains on the accumulated detection amount. Since the control unit 34 calculates the alternative correction amount based on such an accumulated detection amount, the target transport amount is calculated, in which the slippage amount between the continuous paper P and the drive roller of the feed roller pair 22 or the variation amount of the accumulated detection amount with respect to the accumulated instruction amount due to the circumferential shape of the drive roller is reflected.

In addition, the unit instruction amount is changed depending on the transport position of the continuous paper P in some cases, such as the unit instruction amount becomes less at an end portion of the continuous paper P in the transport direction Y, or the unit instruction amount becomes greater at the center of the continuous paper P in the transport direction Y. Accordingly, as the unit instruction amount varies, the unit detection amount also varies. Therefore, when the unit detection amount is the abnormal value, the unit detection amount is replaced with the pre-specified fixed value and the target transport amount is calculated, a difference between the fixed value and the unit detection amount becomes greater in some cases. When the accumulated detection amount is calculated in a state in which the difference between the fixed value and the unit detection amount becomes greater, the difference from the actual accumulated detection amount becomes greater.

Alternatively, in the printer 11 of the present embodiment, when the unit detection amount is the abnormal value, the control unit 34 replaces the unit detection amount with the unit instruction amount corresponding to the unit detection amount. Therefore, the difference between the unit detection amount and the unit instruction amount is suppressed not to become greater and the difference between the actual accumulated detection amount and the accumulated detection amount calculated by replacing the unit detection amount with the unit instruction amount is suppressed not to become greater.

In the printer 11 of the present embodiment, it is possible to achieve the following effects.

(1) When the unit detection amount is an abnormal value, the control unit 34 calculates, based on the alternative correction amount, the target transport amount in which the slippage amount between the continuous paper P and the drive roller of the feed roller pair 22 and the variation amount of the accumulated detection amount with respect to the accumulated instruction amount due to the circumferential shape of the drive roller is reflected. Therefore, it is possible to prevent inaccurate transport of the continuous paper P.

(2) The control unit 34 calculates the correction amount (alternative correction amount) based on a value obtained by dividing a value obtained by subtracting the accumulated instruction amount from the accumulated detection amount, by the accumulated instruction amount. Therefore, it is possible to calculate a correction amount (alternative correction amount) per the unit instruction amount (unit detection amount).

(3) The control unit 34 calculates the target transport amount based on the accumulated detection amount which is the detection amounts per one rotation of the drive roller of the feed roller pair 22. Therefore, it is possible to calculate the target transport amount obtained by smoothing the variation of the accumulated detection amount due to the circumferential shape of the drive roller. Therefore, even when a predetermined unit detection amount becomes a value greatly different from the other unit detection amount due to the circumferential shape of the drive roller, the variation of the target transport amount is suppressed not to be great. Thus, it is possible to prevent the inaccurate transport of the continuous paper P.

(4) As the number of the accumulated unit detection amounts becomes greater, the reflection of the slippage amount between the continuous paper P and the drive roller of the feed roller pair 22 and the variation of the transport amount depending on the circumferential shape of the drive roller becomes less in each of the unit detection amounts. When the accumulated detection amount is calculated, the control unit 34 removes the oldest unit detection amount of the accumulated detection amount as the next unit detection amount is added. In this manner, when the accumulated detection amount is calculated, the upper limit of the number of the unit detection amounts is provided and thereby, it is possible to calculate the target transport amount in a state in which the reflection of the slippage amount between the continuous paper P and the drive roller and the variation of the transport amount due to the circumferential shape of the drive roller remains in each of the unit detection amounts.

The embodiments described above may be modified as another embodiment as follows.

In the embodiments described above, the accumulated detection amount and the accumulated instruction amount may be an accumulated amount other than the amount accumulated during one rotation of the drive roller of the feed roller pair 22. It is preferable that the accumulated detection amount and the accumulated instruction amount are the amount accumulated during at least one rotation of the drive roller of the feed roller pair 22. In short, the accumulated detection amount and the accumulated instruction amount may be an accumulation of the unit detection amounts a plurality of times and an accumulation of the unit instruction amounts a plurality of times.

In the embodiment described above, the unit detection amount and the unit instruction amount may be a detection amount and an instruction amount per detection timing per one operation of the imaging unit 26. In addition, the unit detection amount and the unit instruction amount may be a detection amount and an instruction amount per one pulse of the feed motor.

As long as the printing apparatus can perform printing on the medium such as the continuous paper, the printing apparatus may be a dot impact printer or a laser printer. In addition, the printing apparatus is not limited to a printer which has only a printing function, but may be a multifunction printer. Further, the printing apparatus is not limited to a serial printer, but may be a line printer or a page printer.

As long as the texture can be imaged from the medium, the medium is not limited to the continuous paper, but may be a resin film, metal foil, a metal film, a composite film of resin and metal (laminated film), a textile, a nonwoven fabric, or a ceramic sheet.

The entire disclosure of Japanese Patent Application No. 2014-060870, filed Mar. 24, 2014 is expressly incorporated by reference herein.

What is claimed is:

1. A printing apparatus comprising:

a transport unit that has a transport roller which transports a medium;

a detection unit that has an image acquiring section which acquires an image of the medium and that detects a detection amount of the medium based on the image acquired by the image acquiring section; and a control unit that calculates a correction amount from the detection amount, wherein the control unit controls the transport unit based on the correction amount, and wherein, when the detection amount is an abnormal value, the transport unit is controlled based on the correction amount calculated by the control unit, wherein the correction amount is calculated using a detection amount that is detected by the detection unit before the detection amount becomes the abnormal value.

2. The printing apparatus according to claim 1, wherein the detection unit is located beneath the medium such that it detects the movement of a bottom surface of the medium.

3. A printing apparatus comprising:

a transport unit that has a transport roller which transports a medium;

a detection unit that has an image acquiring section which acquires an image of the medium and that detects a detection amount of the medium based on the image acquired by the image acquiring section; and a control unit that calculates a correction amount from the detection amount, wherein, the control unit when the detection amount is a normal value, calculates a first correction amount from the detection amount and an instruction amount which is an instructed value by which the medium is transported, and controls the transport unit based on a target transport amount which is a target value of transport of the medium and includes the first correction amount, and when the detection amount is an abnormal value, calculates a second correction amount, second correction amount calculated by the control unit based on a detection amount that is detected by the detection unit before the detection amount becomes the abnormal value, and controls the transport unit based on the target transport amount that includes the second correction amount.

4. The printing apparatus according to claim 3, wherein the control unit acquires unit instruction amounts which are transport instruction amounts per one transport process of the medium, and when the detection amount is an abnormal value, adds the alternative correction amount to a unit instruction amount in a next transport process and calculates the target transport amount.

5. The printing apparatus according to claim 3, wherein the control unit acquires unit instruction amounts which are transport instruction amounts per one transport process of the medium and unit detection amounts which are the detection amounts per one transport process of the medium, stores accumulated detection amount which is obtained by accumulating a plurality of the unit detection amounts and calculates a correction amount for each of the unit instruction amount based on the accumulated detection amount, and when the detection amount is abnormal value, replaces the unit detection amount that includes the abnormal value, of the accumulated detection amount, with the unit instruction amount corresponding to the unit detection amount, and calculates the alternative correction amount.

6. The printing apparatus according to claim 5, wherein the unit detection amounts of at least one rotation of the transport roller are accumulated in the accumulated detection amount.

7. The printing apparatus according to claim 5, wherein the accumulated detection amounts are a transport amount which is obtained by accumulating N ($N \geq 2$ and N is an integer) unit detection amounts, and wherein, when the unit detection amount is newly added to the accumulated detection amount, the control unit removes, from the accumulated detection amount, the unit detection amount before the N-th unit detection amount from the latest.

* * * * *